US008015772B2

(12) United States Patent
Jensen

(10) Patent No.: US 8,015,772 B2
(45) Date of Patent: Sep. 13, 2011

(54) TWO PART INTERLOCKING UNIT BLOCK WALL BUILDING SYSTEM

(76) Inventor: David Jensen, Santa Rosa, CA (US)

( * ) Notice: Subject to any disclaimer, the term of this patent is extended or adjusted under 35 U.S.C. 154(b) by 202 days.

(21) Appl. No.: 12/544,028

(22) Filed: Aug. 19, 2009

(65) Prior Publication Data

US 2010/0043336 A1 Feb. 25, 2010

Related U.S. Application Data

(60) Provisional application No. 61/090,113, filed on Aug. 19, 2008.

(51) Int. Cl.
*E04C 3/30* (2006.01)

(52) U.S. Cl. ..... 52/574; 52/503; 52/561; 52/608; 405/262; 405/284; 405/286

(58) Field of Classification Search ..... 52/574, 52/503, 419, 422, 424, 432, 561, 608, 609; 405/284, 286, 262
See application file for complete search history.

(56) References Cited

U.S. PATENT DOCUMENTS 3,418,774 A * 12/1968 Kocher et al. ..... 52/437
5,688,078 A * 11/1997 Hammer ..... 405/286
5,820,305 A * 10/1998 Taylor et al. ..... 405/286
5,901,520 A * 5/1999 Abdul-Baki ..... 52/592.6
6,168,353 B1 1/2001 Price
6,168,354 B1 1/2001 Martin
6,205,735 B1 * 3/2001 Witcher ..... 52/604
6,253,519 B1 * 7/2001 Daniel ..... 52/591.1
6,523,317 B1 2/2003 Bott
6,568,143 B2 * 5/2003 Coleman ..... 52/604
6,615,561 B2 9/2003 MacDonald
6,651,401 B2 11/2003 Price
6,711,865 B2 * 3/2004 Chaudoreille ..... 52/603
6,745,537 B1 * 6/2004 Hamilton ..... 52/574
6,871,468 B2 3/2005 Whitson
7,748,192 B2 * 7/2010 Ryder ..... 52/569
2001/0019684 A1 * 9/2001 Manthei et al. ..... 405/284
2003/0093967 A1 * 5/2003 Dolan et al. ..... 52/604
2007/0006542 A1 * 1/2007 Duke ..... 52/561
2008/0063480 A1 * 3/2008 Price et al. ..... 405/286
2010/0281809 A1 * 11/2010 Dawson et al. ..... 52/561
2011/0047921 A1 * 3/2011 Witcher ..... 52/565

* cited by examiner

*Primary Examiner* — Brian E Glessner
*Assistant Examiner* — Rodney Mintz
(74) *Attorney, Agent, or Firm* — Craig M. Stainbrook; Stainbrook & Stainbrook, LLP

(57) ABSTRACT

A stackable masonry unit having male and female elements that cooperate with complementary female and male elements on identical, opposing, adjoining units to create an interlocking two- or three-unit module from single design element. Each interlocking module comprises a portion of a course in a block wall made of cementitious material, e.g., a concrete masonry unit or insulating concrete foam.

11 Claims, 16 Drawing Sheets

TWO PART INTERLOCKING UNIT BLOCK WALL BUILDING SYSTEM

CROSS REFERENCES TO RELATED APPLICATIONS

The present application claims the benefit of the filing date of U.S. Provisional Patent Application Ser. No. 61/090,113, filed Aug. 19, 2008.

SEQUENCE LISTING

Not applicable.

STATEMENT REGARDING FEDERALLY SPONSORED RESEARCH OR DEVELOPMENT

Not applicable.

THE NAMES OR PARTIES TO A JOINT RESEARCH AGREEMENT

Not applicable.

INCORPORATION-BY-REFERENCE OF MATERIAL SUBMITTED ON A COMPACT DISC

Not applicable.

BACKGROUND OF THE INVENTION

1. Field of the Invention

The present invention relates to unit-shaped masonry blocks and/or EPS foam blocks, and more particularly to stackable block unit configurations, and still more particularly to a stackable block units having male and female elements that cooperate with complementary female and male elements on identical, opposing, adjoining and/or interlocking blocks (i.e., units) to create an interlocking two- or three-unit module from a single design element. Each interlocking module comprises a portion of a course in a concrete masonry unit wall or insulating concrete form wall.

2. Discussion of Related Art including information disclosed under 37 CFR §§1.97, 1.98

Masonry construction blocks and methods for constructing various kinds of brick or block walls are well known in the art. Because of the difficulty and high cost of constructing walls of quarried stone or block, cast concrete masonry units (CMU) and insulating concrete form (ICF) blocks and systems long ago replaced quarried stone as a preferred material in many applications.

Cast blocks typically have a uniform size and shape, include at least one cavity, and frequently permit physical interlocking, either vertically or horizontally, with integrally formed or independent connection means. Such interlocking designs facilitate rapid assembly and proper alignment during fabrication. They also permit assembly without mortar, so that some designs of cast blocks may be employed for temporary walls that can be easily disassembled.

Walls constructed of cast blocks may rely exclusively on the mass of the blocks to maintain alignment and stability. However, cementitious cast block walls intended for permanent use usually require additional stability. Accordingly, many designs call for the introduction of reinforcement bar extending between blocks, as well as mortar or reinforced concrete to be poured or injected into (and to fill) gaps and aligned vertical and horizontal openings in the blocks.

However, along with their advantages, the known cast blocks also have many disadvantages, including: difficulty in converting the wall units into end or corner units; lateral instability; vulnerability of exposed mortar to chemical or environmental degradation; expansion and contraction of mortar, which causes cracking and separation of blocks; and difficulty in constructing curved configurations. A significant disadvantage of conventional, structural CMU and/or ICF block wall construction is in the awkwardness in placing block units over and around vertical steel reinforcement bars (rebar) and the time required to place horizontal rebar between block unit placements. Finally, many designs are simply not pleasing to the eye.

The following are among the exemplary stackable block systems known in the art:

U.S. Pat. No. 6,168,353, to Price, shows a retaining wall comprising blocks shaped to prevent the escape of material used to fill the cavities of the wall while allowing dissipation of pressures exerted on the wall by retained earth. The method of constructing the wall takes advantage of continuous and uninterrupted vertical cavities formed by the shape of the blocks, which includes a front portion interconnected to a rear portion which has ears on opposite sides which cooperate on adjacent blocks to create a tortuous path into a space created between two adjacent blocks.

U.S. Pat. No. 6,168,354 to Martin, et al, teaches a modular wall block having a locking shear key that extends outwardly from either the top or bottom of the block. A severable area formed with the shear key and can be removed to accommodate placement and orientation of the wall block between respective adjacent sides of like blocks in an adjacent upper or lower course.

U.S. Pat. No. 6,523,317, to Bott, et al, describes a trapezoidal wall block having parallel front and rear surfaces and opposed top and bottom surfaces. The top surface has front and rear lips with mutually opposed triangular portions converging inwardly to define opposed and aligned front and rear apices. The bottom surface of the block includes a central base with opposed notches formed along the front and rear edges of the bottom surface, with the base having a trapezoidal configuration with a width dimension which is no greater than the spacing between the opposed aligned front and rear apices.

U.S. Pat. No. 6,615,561 to MacDonald, et al, teaches a retaining wall block with a core, pin receiving cavities, and pin holes. The pin receiving cavities and pin holes are arranged symmetrically on the block and outside of the corner segments. U.S. Pat. No. 6,651,401, to Price, et al, shows aretaining wall that calls for a series of differently sized, pre-formed horizontal and vertical blocks. Each block includes a projection and a recess, with the projection and recess arranged and configured so that each projection effectively engages a recess in an adjacent course to operatively connect adjacent courses together.

U.S. Pat. No. 6,871,468, to Whitson, describes an interlocking masonry wall block with two spaced lugs or projections and a cooperating recess or channel. The block can be stacked in courses in a staggered configuration such that each block is stacked atop two immediately lower blocks. In each embodiment, the lugs and their cooperating channel or recess define a setback dimension.

Known prior art products include the APEX block made by Apex Construction Systems of Portland, Oreg.

Rastra Block, by Rastra Corporation of Scottsdale, Ariz., is increasingly seen as making a meaningful contribution to green construction practices. It is a composite insulating concrete form (ICF) wall-construction material made from concrete and pelletized recycled styrofoam. It is formed in elongate panels having a plurality of holes that align with adjoining blocks when stacked. This forms contiguous vertical and horizontal channels for the placement and containment of rebar and concrete fill.

Perform Wall Panel Systems, by Perform Wall, LLC, of El Paso, Tex. utilizes another insulated concrete form quite similar to Rastra blocks. It is made of a combination of cement, polystyrene, water, and additives. The panel stack geometry creates a grid pattern that produces voids for placement of rebar and concrete in-fill. A wall constructed from these forms purportedly provides a fire, sound and thermal barrier that is virtually impervious to earthquake, fire, wind, water, heat and cold.

The foregoing patents and prior art products reflect the current state of the art of which the present inventor is aware. Reference to, and discussion of, these patents and products is intended to aid in discharging Applicant's acknowledged duty of candor in disclosing information that may be relevant to the examination of claims to the present invention, when such claims are presented in a non-provisional patent application. However, it is respectfully submitted that none of the above-indicated patents disclose, teach, suggest, show, or otherwise render obvious, either singly or when considered in combination, the invention described and claimed herein.

SUMMARY OF THE INVENTION

The present invention is a monolithic block that functions as a unit in a block wall building system. It is used for constructing block walls. The unit includes a substantially planar front face, a first edge, a second edge, a first end, a second end, and a back face. Projecting outwardly from the back face is at least one, and preferably two, male interlocking elements. These elements are integral with the back face and include a tapering leg portion which expands proximally to distally as it projects and extends into an ankle portion. The ankle portion further expands into a shoe portion, which has structural features that may be conveniently compared to the elements typically forming a shoe, including a planar sole, an outboard upper portion, an inboard upper portion, each being generally normal to the planar sole and adjoining the sole in outboard and inboard edges, a generally flat toe, a heel, a vamp, and a topline.

The units next include a female interlocking element integrally formed as a female concavity in each of the leg and ankle portions of the male interlocking elements. Accordingly, the female interlocking elements include a sole side and approximates the sole of the male element, a medial upper side that approximates the inboard upper portion of the male element, a lateral upper side that approximates the outboard upper portion of the male element, and so forth.

To combine blocks into an interlocked unit, the back faces are put into an opposing position and the male elements of one block are oriented in toe up position while the male elements of the opposing block are oriented with the male elements in a toe down position. Thus, when two of the inventive monolithic blocks are aligned for interlocking relationship with one another, the female interlocking elements on one of the blocks accepts and conforms precisely to corresponding complementary male interlocking elements on opposing blocks. In effecting the mating relationship, the heel portions of the male interlocking elements on one block slidingly insert into the female concavities on an opposing block to form upper and lower interlocked blocks. The combination of two opposing blocks at the same level form a portion of a course in a wall.

It is therefore a principal object of the present invention to provide a new and improved wall building unit having a single design adapted for use in forming two- or three-unit interlocking courses in the collective construct of structural walls.

It is another object of the present invention to provide a new and improved block building unit that interlocks with one or more identical units and stacks atop and/or below identical units to form a wall, and when so configured the interlocking units form horizontal and vertical voids suitable for accepting rebar and fill material.

A further object of the present invention is to provide a new and improved structural building unit having a novel design that enables prefabrication and unit placement of a grid or matrix of steel reinforcement bars and the subsequent placement of interlocking wall units around the pre-placed rebar grid.

Still another object of the present invention is to provide a structural building unit in which interlocking of units requires no adhesive or external shoring and bracing while the internal voids formed by the combined units are filled with concrete.

Yet another object of the present invention is to provide an improved block building unit in which each element of the unit can be easily adapted, sized, and scaled for specific applications.

The foregoing summary broadly sets out the more important features of the present invention so that the detailed description that follows may be better understood, and so that the present contributions to the art may be better appreciated. There are additional features of the invention that will be described in the detailed description of the preferred embodiments of the invention which will form the subject matter of the claims appended hereto.

Accordingly, before explaining the preferred embodiment of the disclosure in detail, it is to be understood that the disclosure is not limited in its application to the details of the construction and the arrangements set forth in the following description or illustrated in the drawings. The inventive apparatus described herein is capable of other embodiments and of being practiced and carried out in various ways.

Also, it is to be understood that the terminology and phraseology employed herein are for descriptive purposes only, and not limitation. Where specific dimensional and material specifications have been included or omitted from the specification or the claims, or both, it is to be understood that the same are not to be incorporated into the appended claims.

As such, those skilled in the art will appreciate that the conception, upon which this disclosure is based may readily be used as a basis for designing other structures, methods, and systems for carrying out the several purposes of the present invention. It is important, therefore, that the claims are regarded as including such equivalent constructions as far as they do not depart from the spirit and scope of the present invention. Rather, the fundamental aspects of the invention, along with the various features and structures that characterize the invention, are pointed out with particularity in the claims annexed to and forming a part of this disclosure. For a better understanding of the present invention, its advantages and the specific objects attained by its uses, reference should be made to the accompanying drawings and descriptive matter in which there are illustrated the preferred embodiment.

BRIEF DESCRIPTION OF THE SEVERAL VIEWS OF THE DRAWINGS

The invention will be better understood and objects other than those set forth above will become apparent when consideration is given to the following detailed description thereof. Such description makes reference to the annexed drawings wherein.

DETAILED DESCRIPTION OF THE INVENTION

Figure 1:
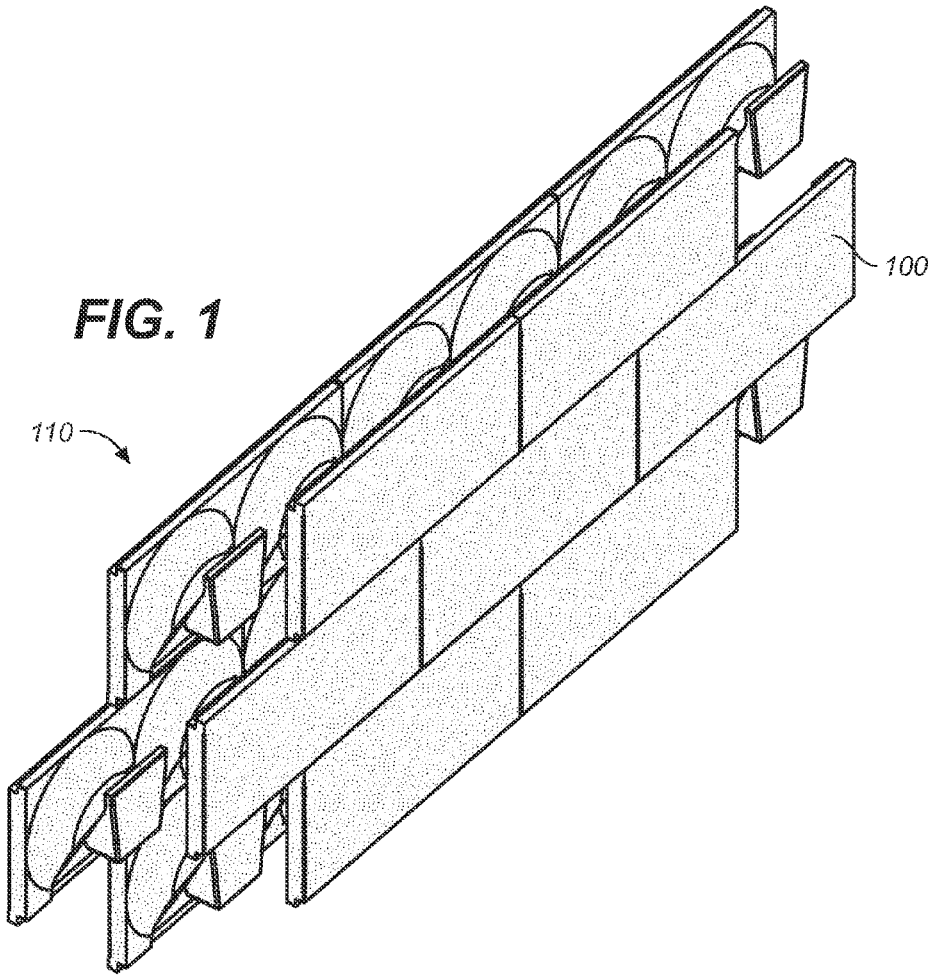
FIG. 1 is a perspective view of a wall constructed with three stacked courses of the cementitious block of the present invention.

Referring to FIGS. 1 through 20, wherein like reference numerals refer to like components in the various views, there is illustrated therein a new and improved two-part interlocking lightweight block and block wall building system. The first preferred embodiment of the inventive block is generally denominated 100 herein. A wall constructed of the inventive interlocking blocks is shown in FIG. 1 and is denominated 110. The units may be fabricated from a number of suitable materials, though preferred materials include lightweight concrete, cellular concrete, glass fiber reinforced concrete (GFRC), cellulose fiber reinforced concrete, expanded polystyrene foam (EPS foam), recycled EPS foam bead concrete, and the like.

FIG. 1 shows a wall constructed with three courses using the first preferred embodiment 100 of the cementitious block of the present invention, the details of which are shown in FIGS. 5-12. FIGS. 1-4D show how the block elements of the first preferred embodiment combine to form interlocking units for such a wall construction. FIGS. 13-20 depict a second preferred embodiment of the present invention.

Referring first to FIGS. 5-12, there is shown various views of one of the preferred embodiments of the cementitious block of the present invention. These views collectively show that in its most essential form, the block includes a monolithic cementitious unit 100 having a generally planar front face 120, a first edge 130, a second edge 140, a first (right) end 150, a second (left) end 160, a back face 170, and at least one male interlocking element 180. Preferably each block includes two male interlocking elements 180*a*, 180*b*. Each male interlocking element comprises a tapering conical leg 190 which projects and extends outwardly into an integral ankle portion 200, which, in turn, expands into a shoe portion 210. The shoe portion includes a planar sole 220, a lateral (outboard) upper portion 230, a medial (inboard) upper portion 240, a flat toe 250, a heel 260, a vamp 270, and a topline 280. The edge of the adjoining upper and sole portions define a beveled feather 290, and the edges 300 of the adjoining heel and upper portions are also beveled. The heel includes a rake portion 310 with beveling on its exposed edges 320.

Each male interlocking element includes an integral female interlocking element formed in or cut-out from the leg and ankle portions of the male interlocking element. The female interlocking element is a box shaped concavity 330 defined by a plurality of sides, including a sole side 340, a medial upper side 350, a lateral upper side 360, and beveling 370 at each of the adjoining sides to complement the beveling on the male interlocking element.

Referring to FIGS. 1-4D, it will be appreciated that the female interlocking element conforms precisely to the male interlocking element, such that the heel portion of the male interlocking element slidingly inserts into the female concavity to form upper and lower interlocked blocks 380*a*, 380*b*, respectively, comprising a portion of a course in a wall. When so inserted, the sole of the male element approximates the sole side of the female concavity; the medial upper of the male element approximates the medial upper side of the female concavity, and so forth. To supplement the interlocking features of the male and female interlocking elements, in the first preferred embodiment of the inventive block, the first and second edges are rabbetted. The first edge 130 proximate heel 260 includes one or more projecting portions 130*a* on the outer boundary of the edge, while the second edge 140 proximate toe 250 includes a projecting portion 140*a* on the inner boundary of the edge. Accordingly, as the blocks are interlocked and stacked, the rabbetted edges also cooperate to form a joint that increases the structural integrity of the wall.

Figure 2:
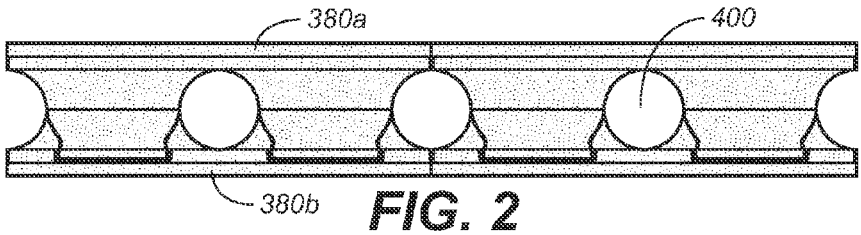
FIG. 2 is a top plan view showing the block configuration in a course of blocks in which each block interlocks with only one other identical block.
Figure 3:
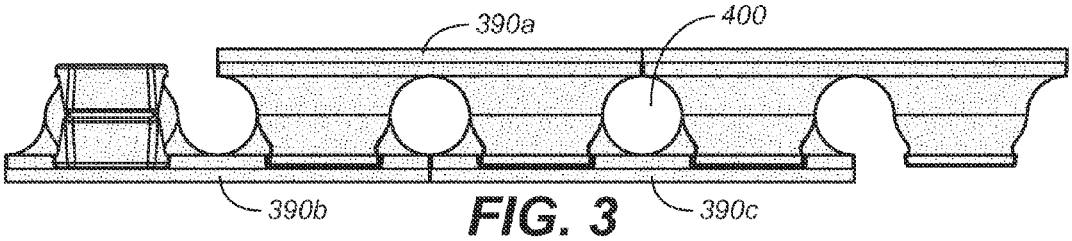
FIG. 3 is a top plan view showing the configuration of blocks in a course in which each block interlocks with two other identical blocks.
Figure 4A:
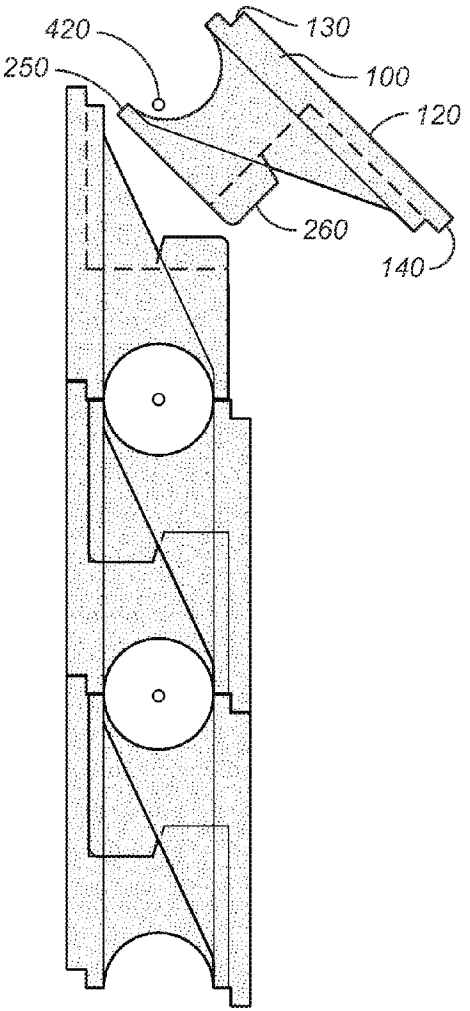
FIGS. 4A-4D are side views in elevation showing how the male element of the inventive block is inserted into the complementary female concavity in an opposing block to form a block unit in a wall.
Figure 4B:
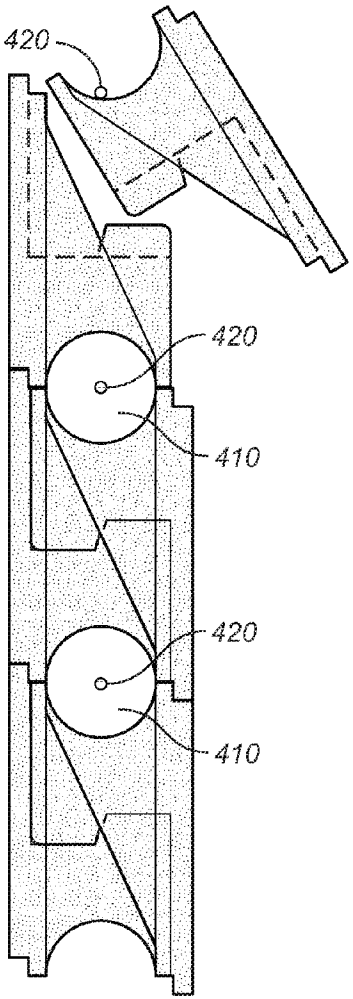
Figure 4C:
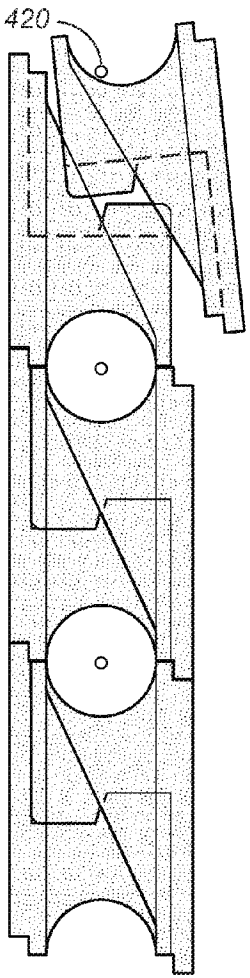
Figure 4D:
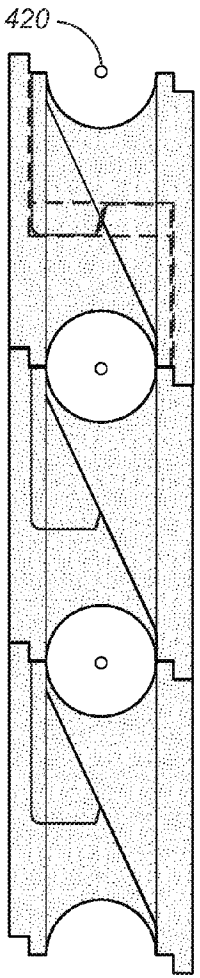
Figure 5:
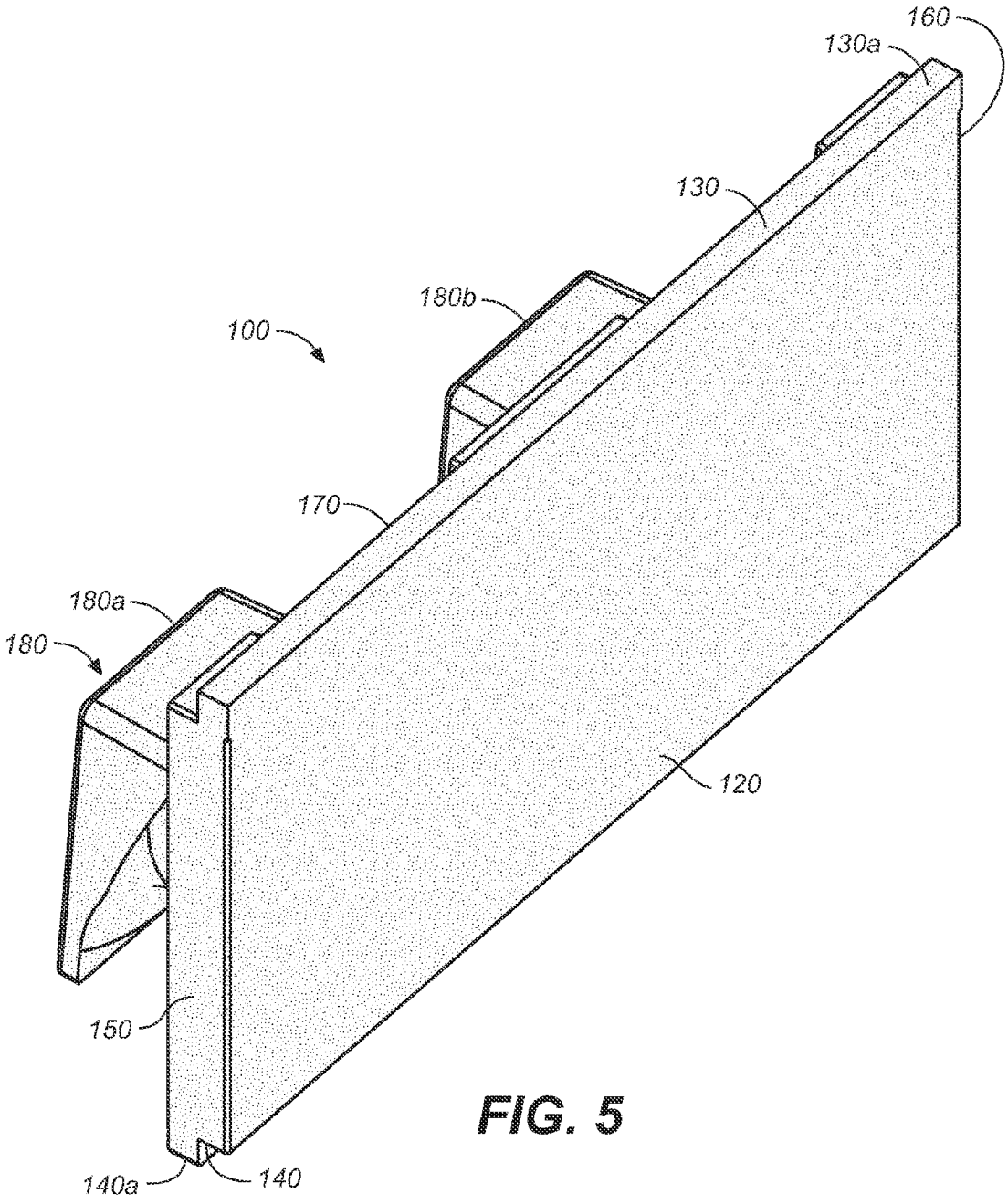
FIG. 5 is an upper right front perspective view showing the front face of a first preferred embodiment of the present invention.
Figure 6:
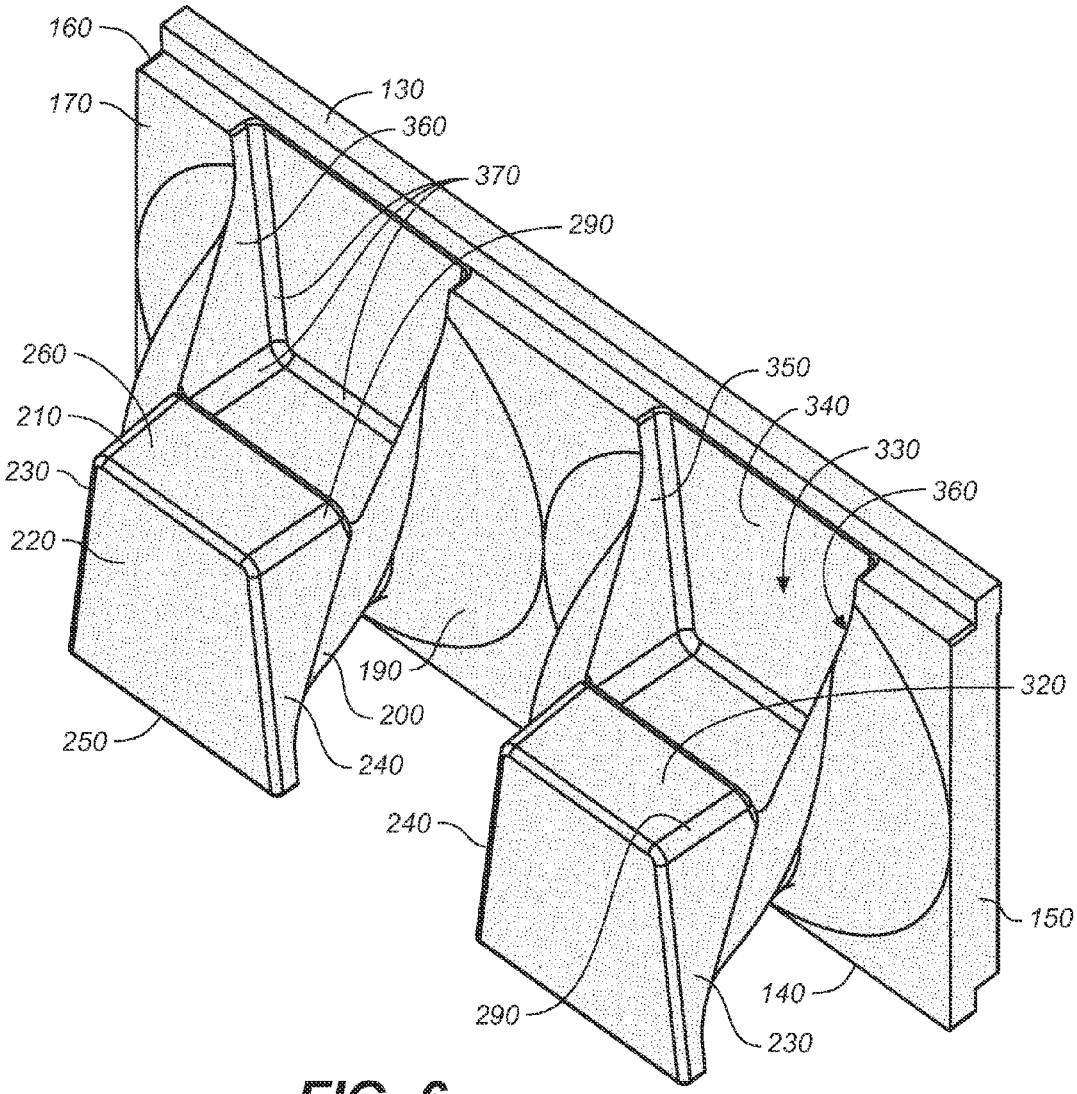
FIG. 6 is an upper right rear perspective view thereof featuring the male projections.
Figure 7:
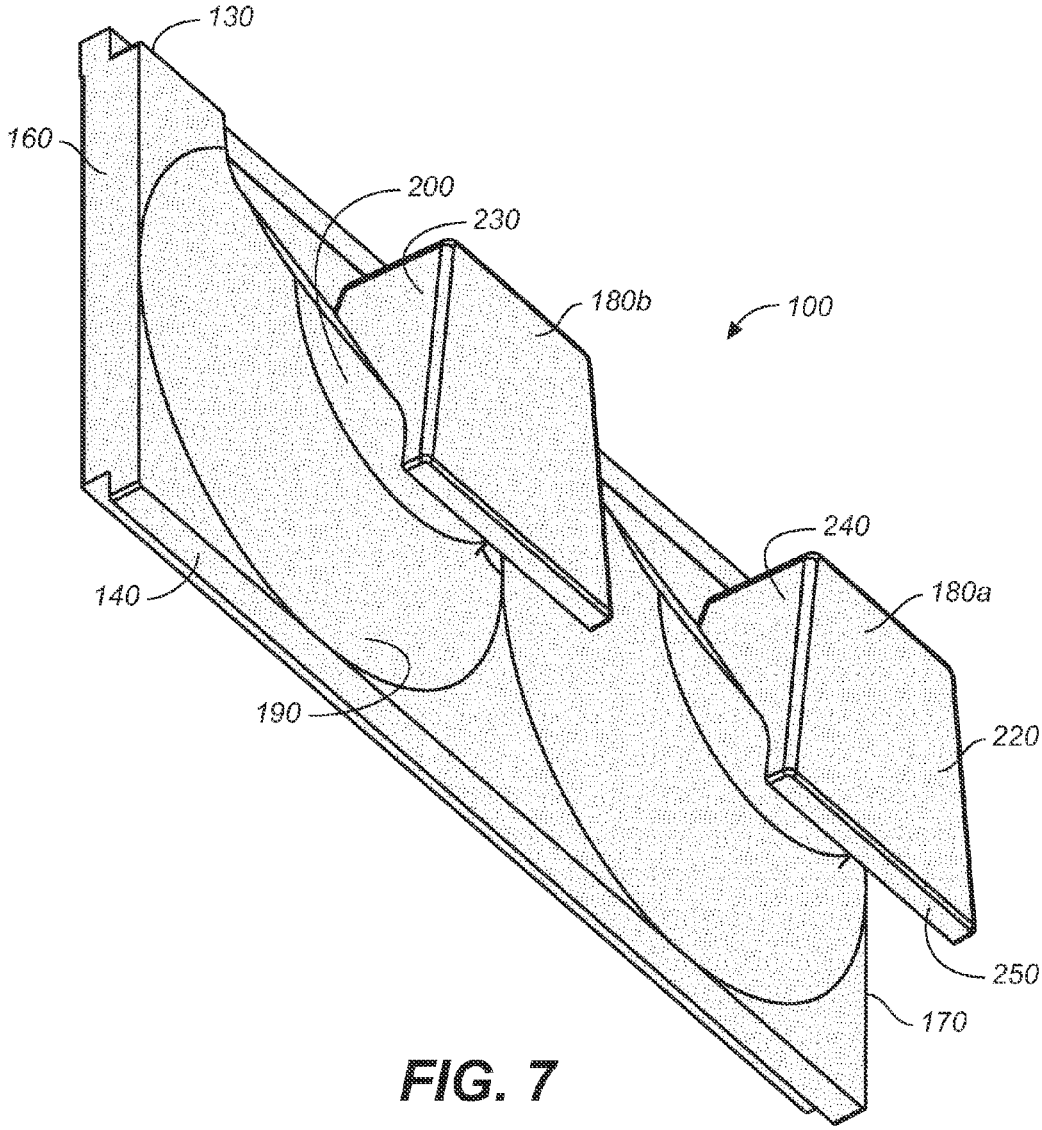
FIG. 7 is a lower left rear perspective view thereof.
Figure 8:
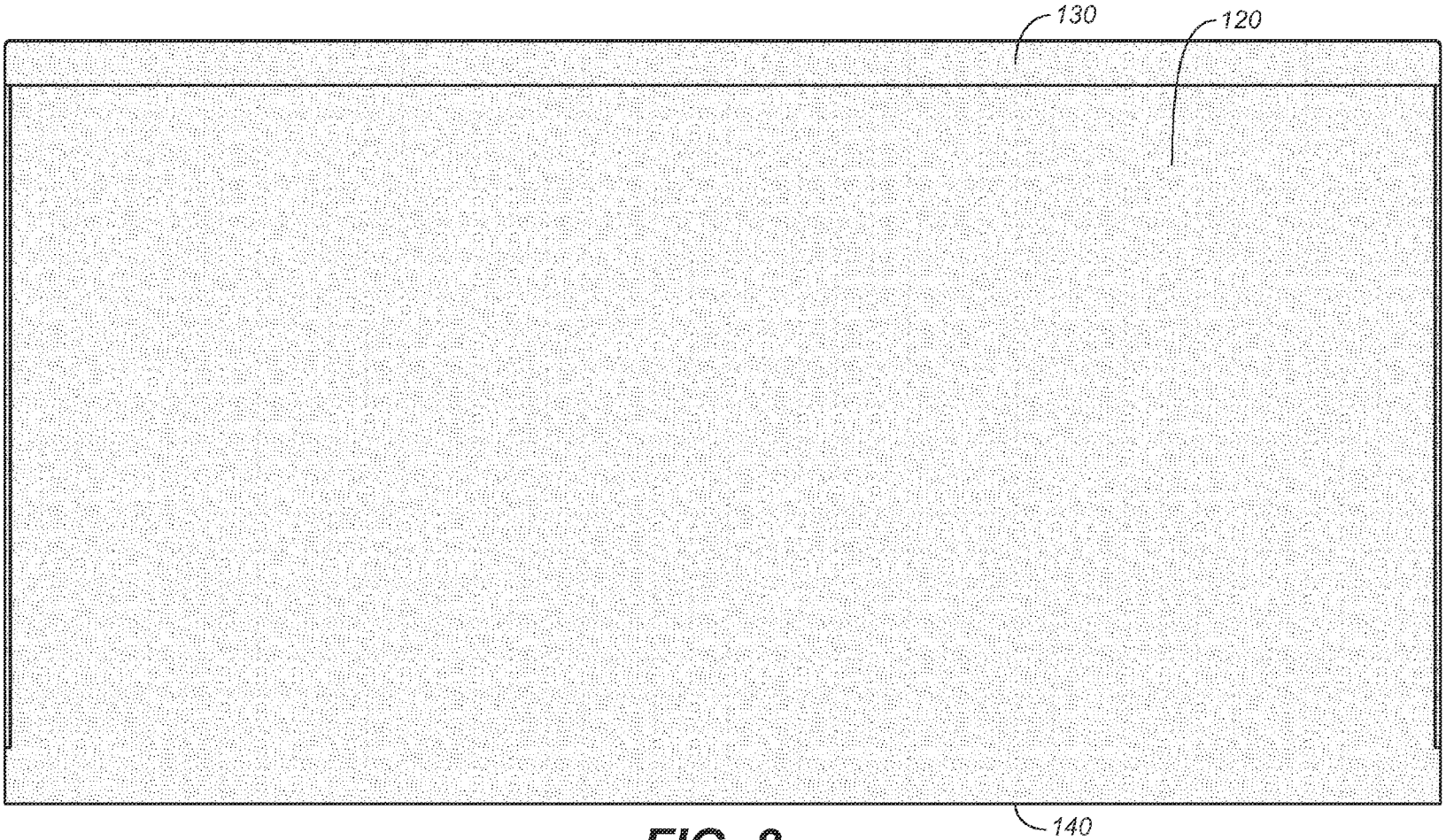
FIG. 8 is a front view in elevation thereof.
Figure 9:
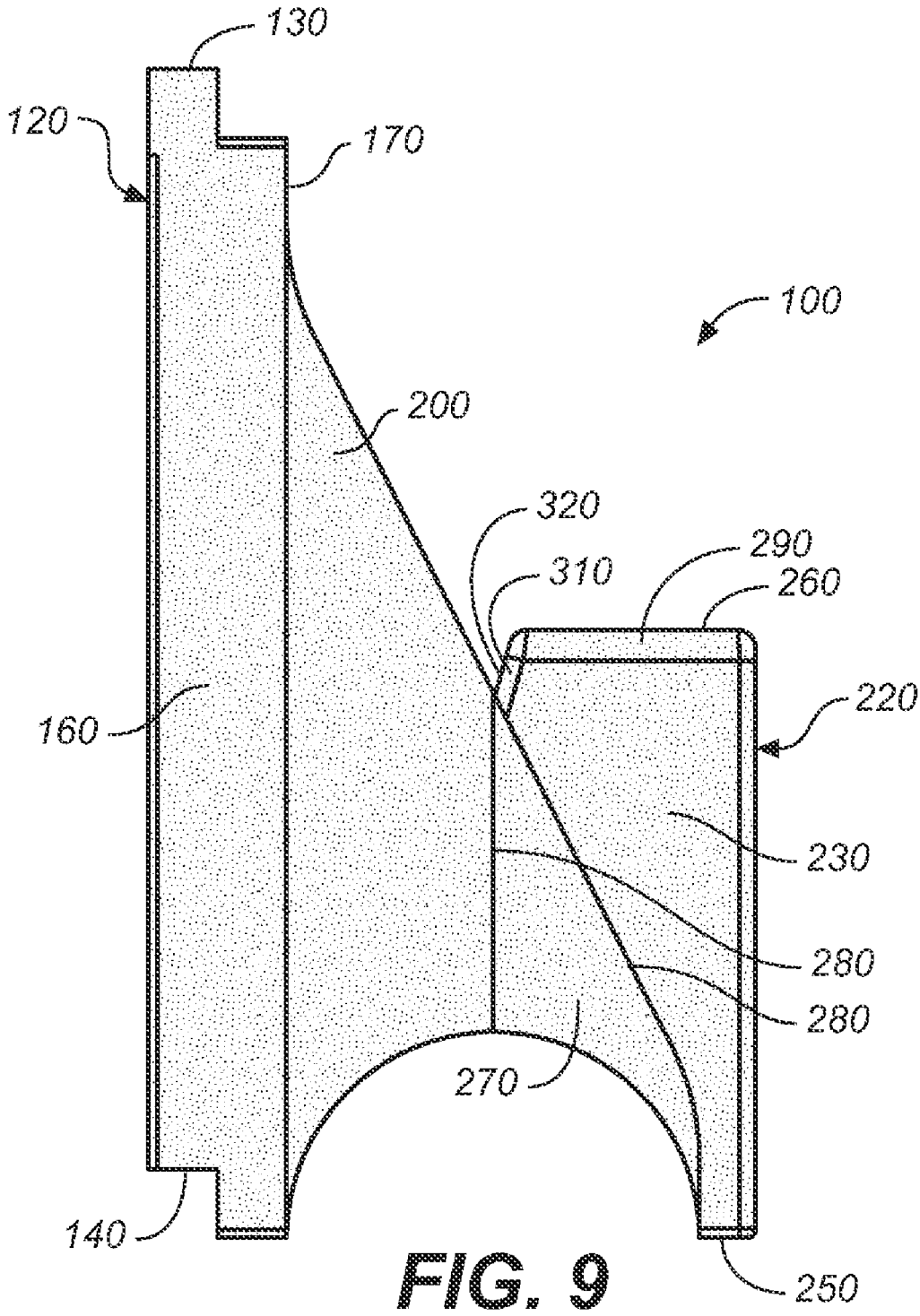
FIG. 9 is a left side view in elevation thereof.
Figure 10:
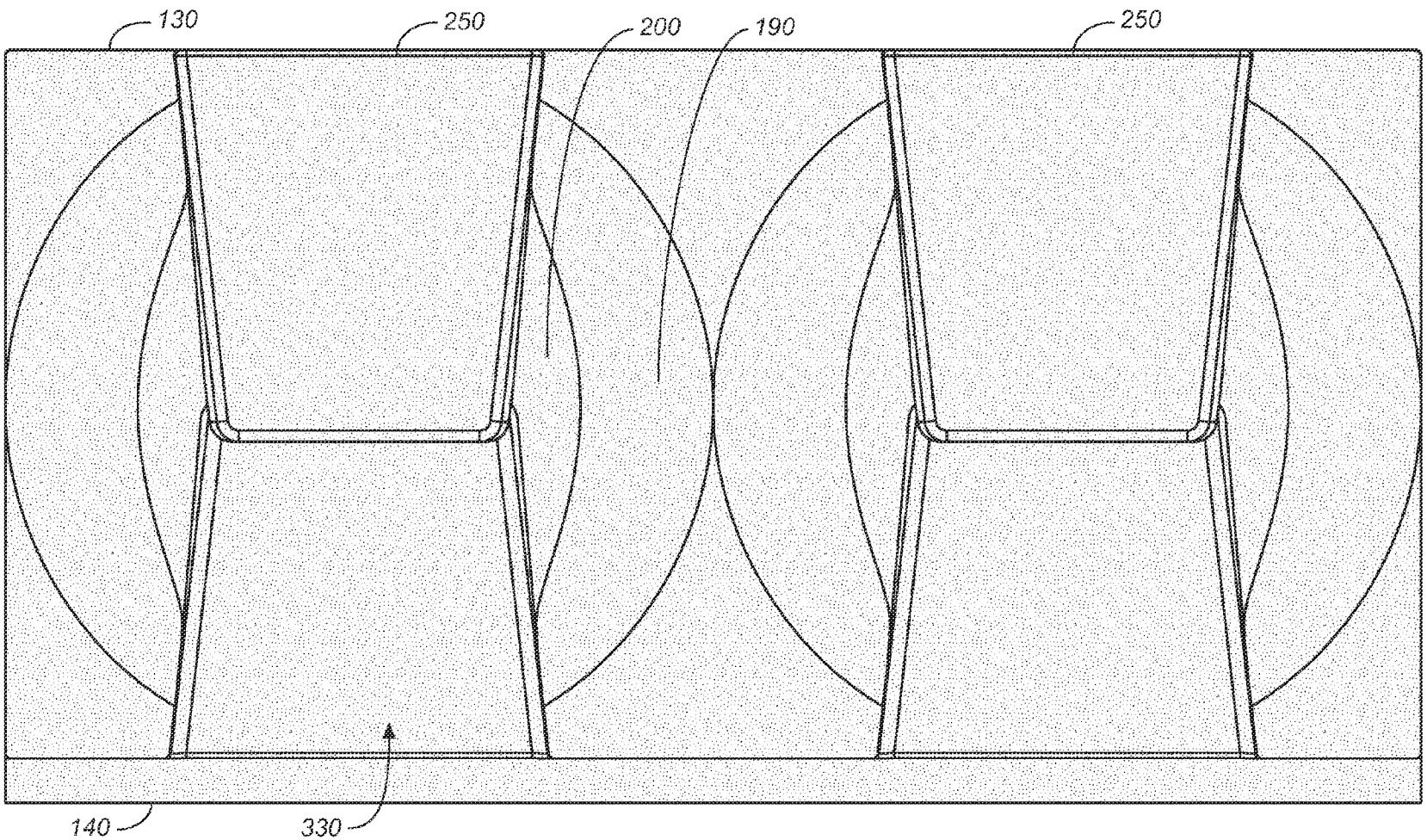
FIG. 10 is a rear view in elevation thereof.
Figure 11:
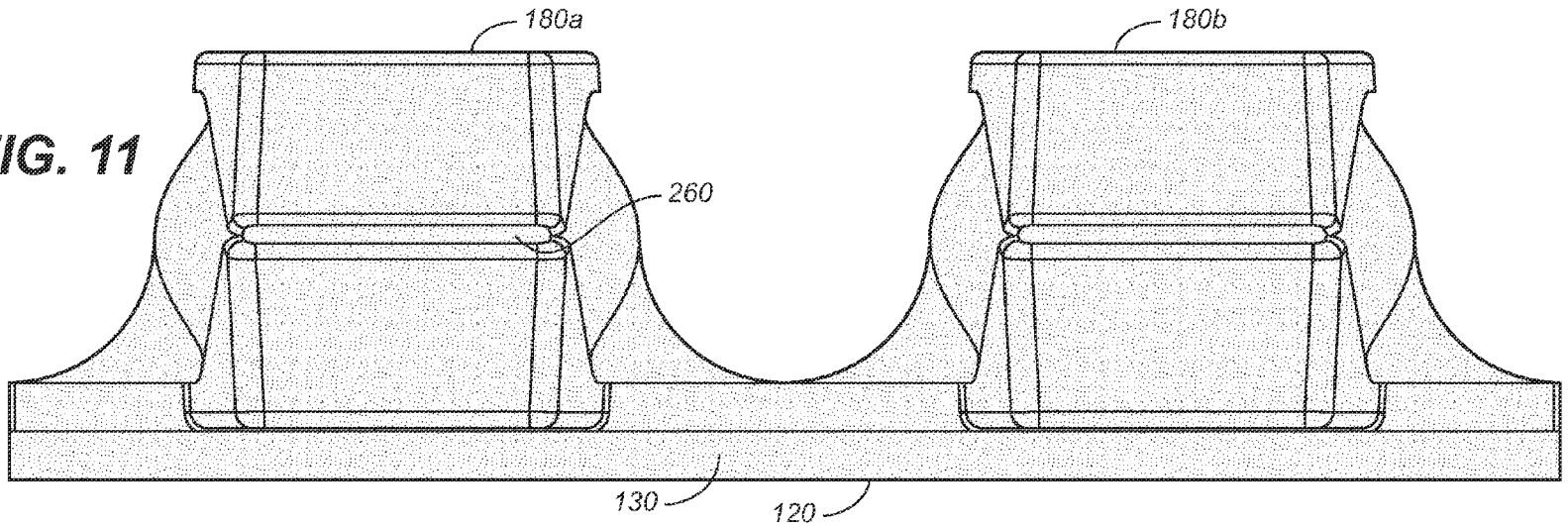
FIG. 11 is a bottom view thereof.
Figure 12:
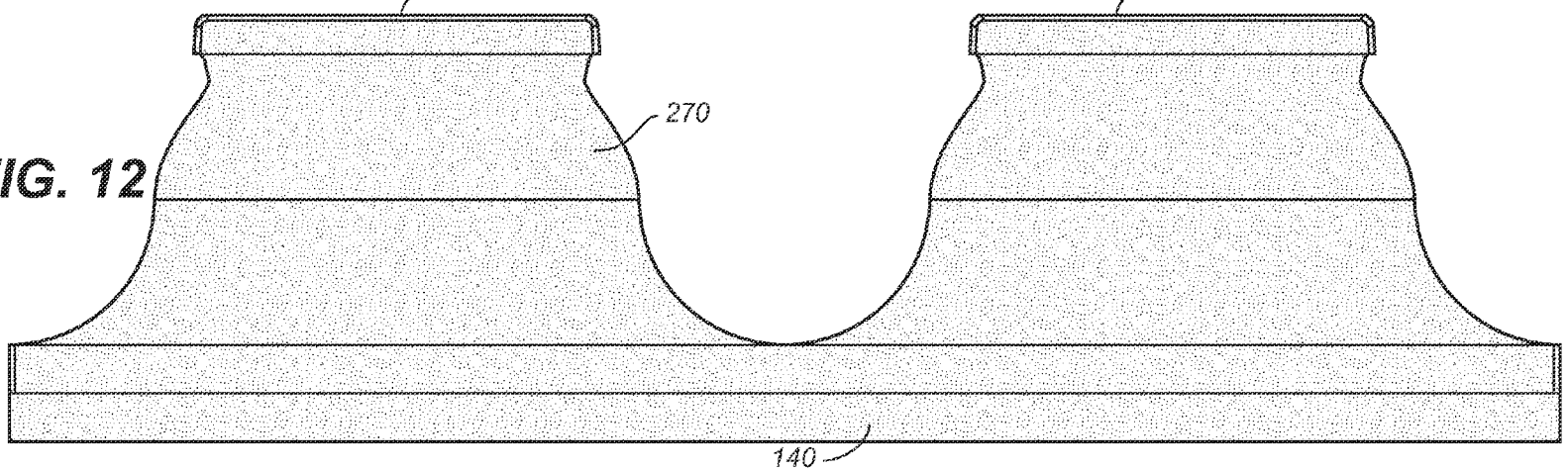
FIG. 12 is a top plan view thereof.
Figure 13:
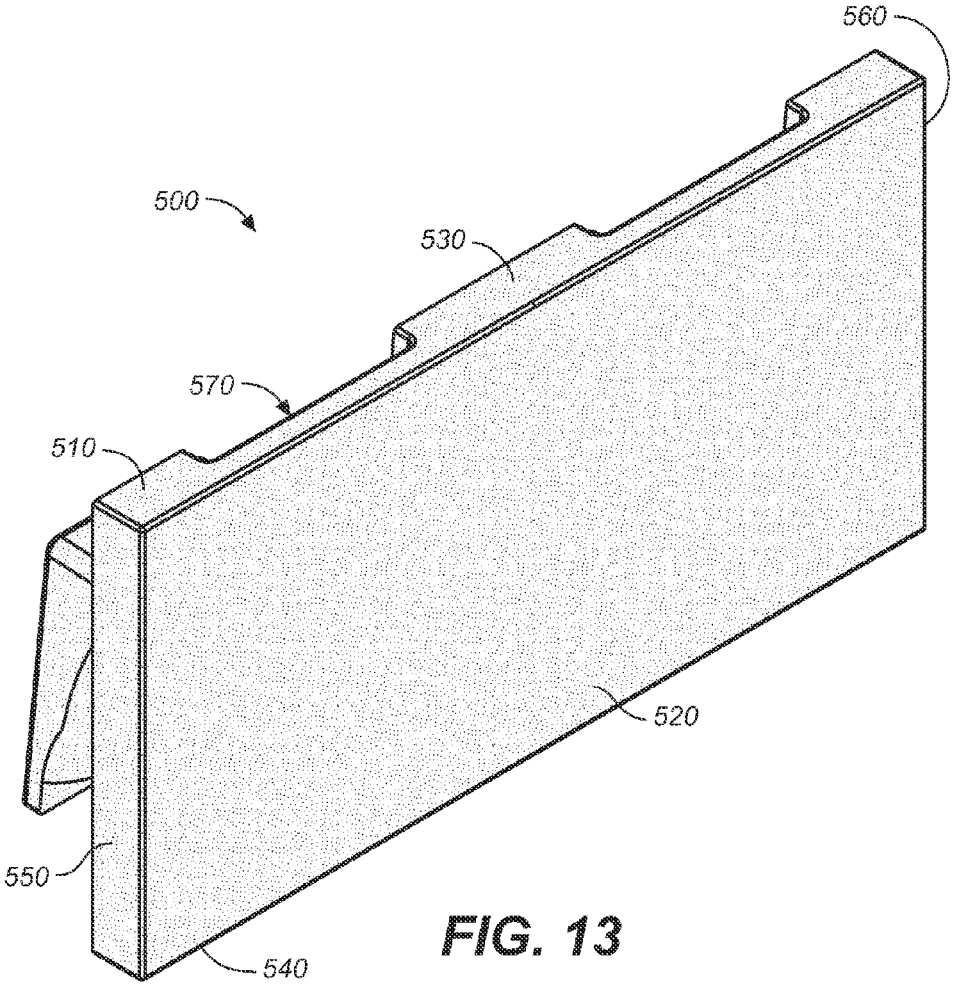
FIG. 13 is an upper right front perspective view of a second preferred embodiment of the present invention.
Figure 14:
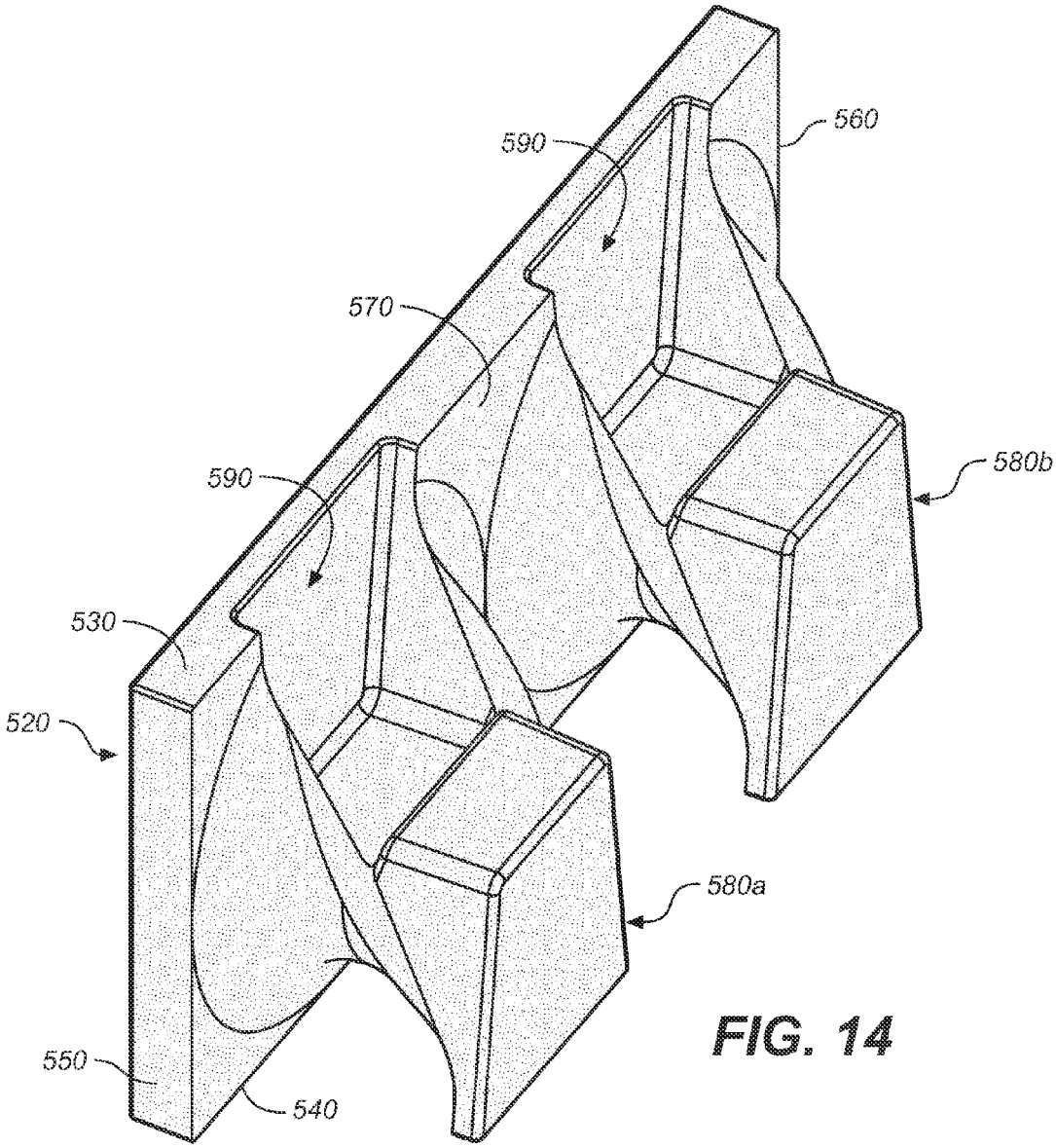
FIG. 14 is an upper left rear perspective view thereof, featuring the male projections.
Figure 15:
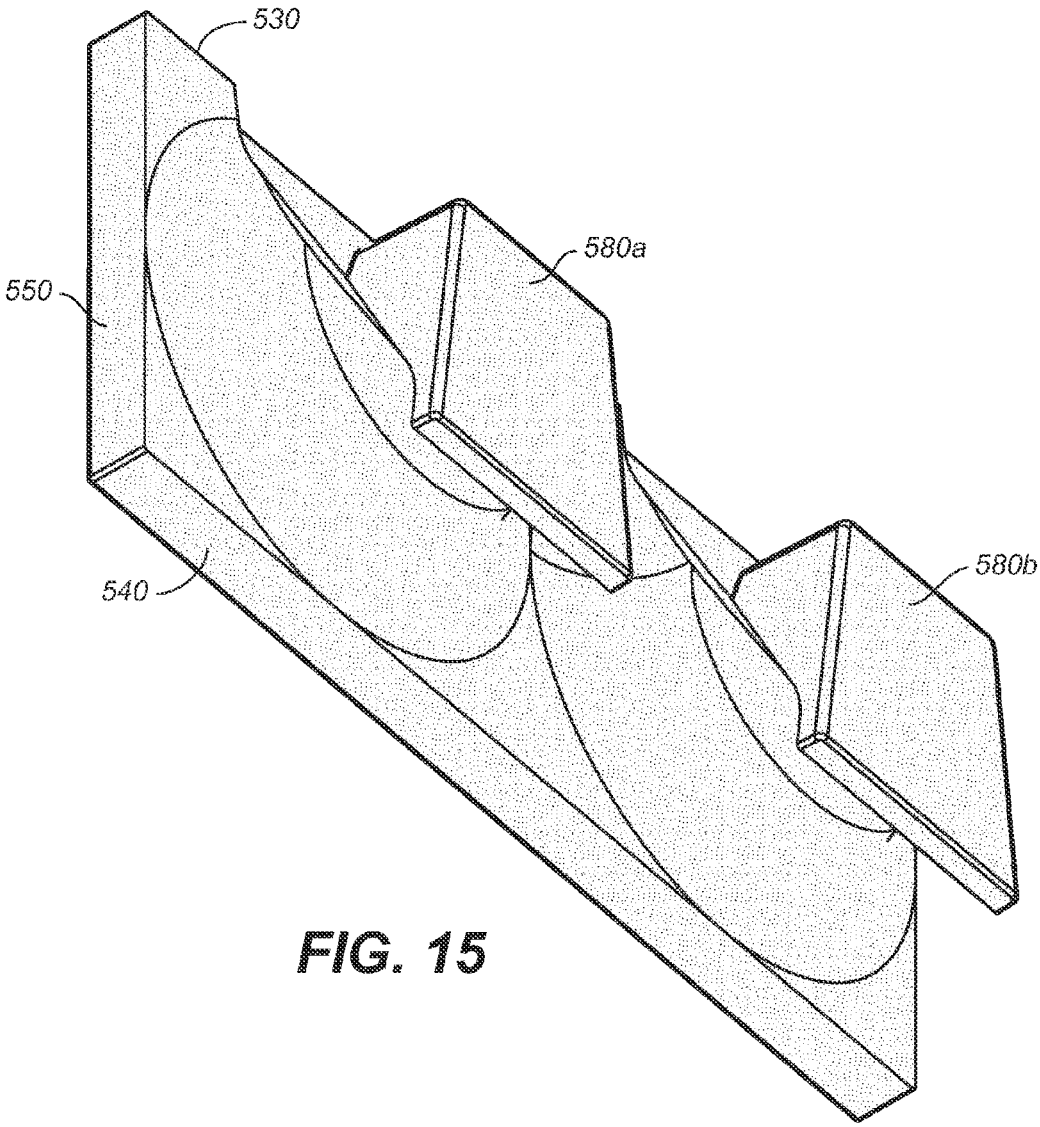
FIG. 15 is a lower left rear perspective view thereof.
Figure 16:
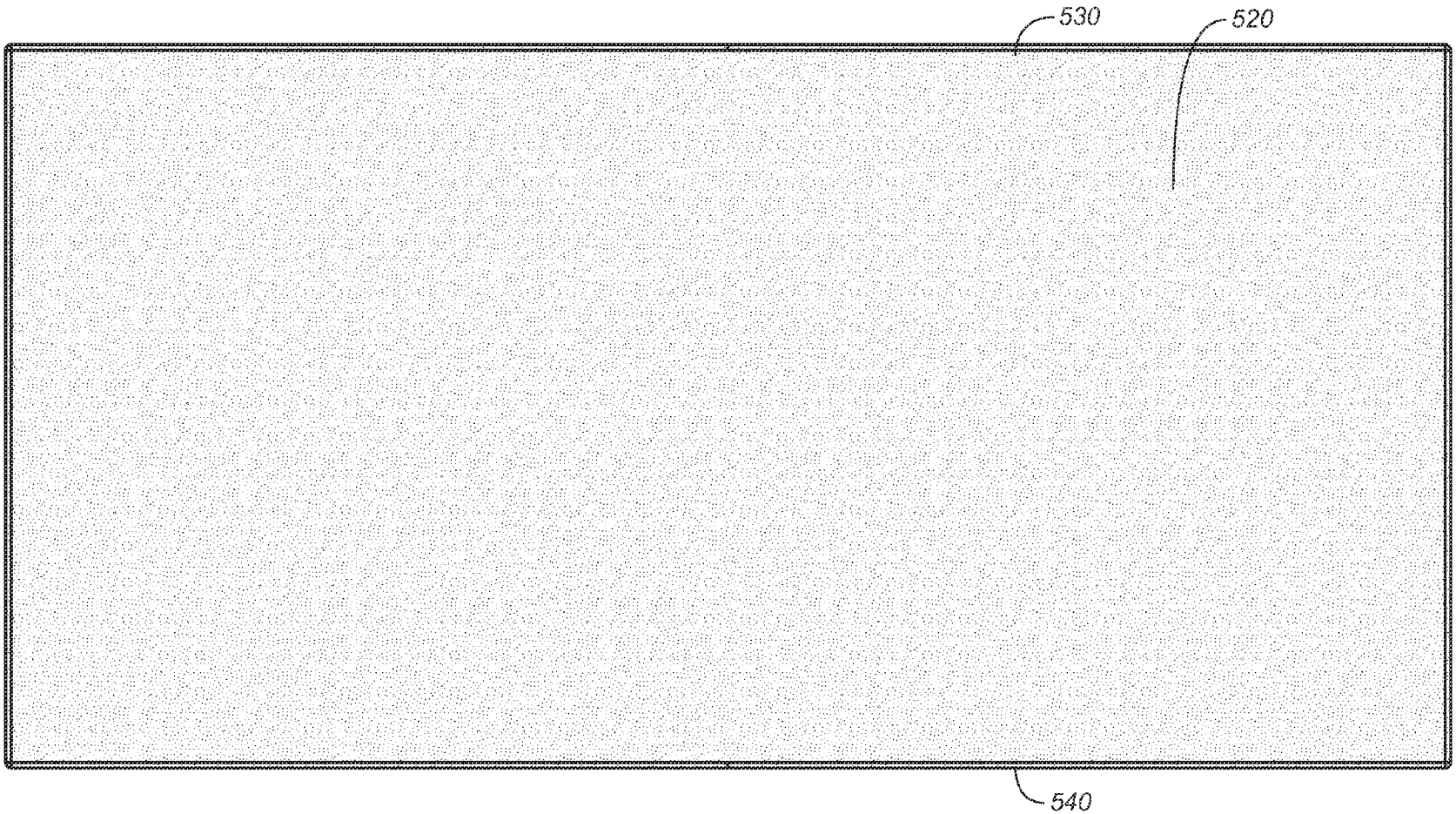
FIG. 16 is a front view in elevation thereof.
Figure 17:
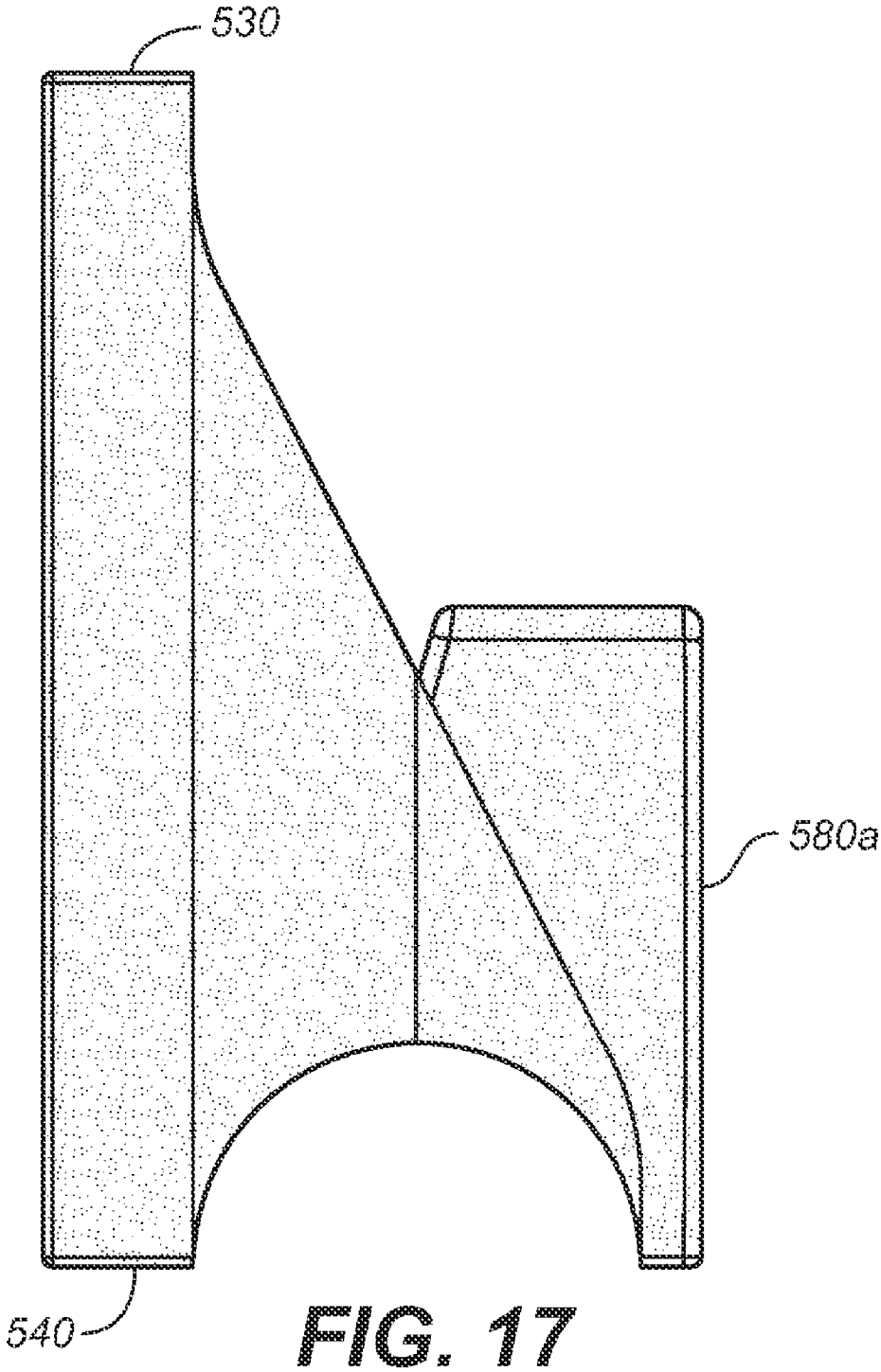
FIG. 17 is a left side view in elevation thereof.
Figure 18:
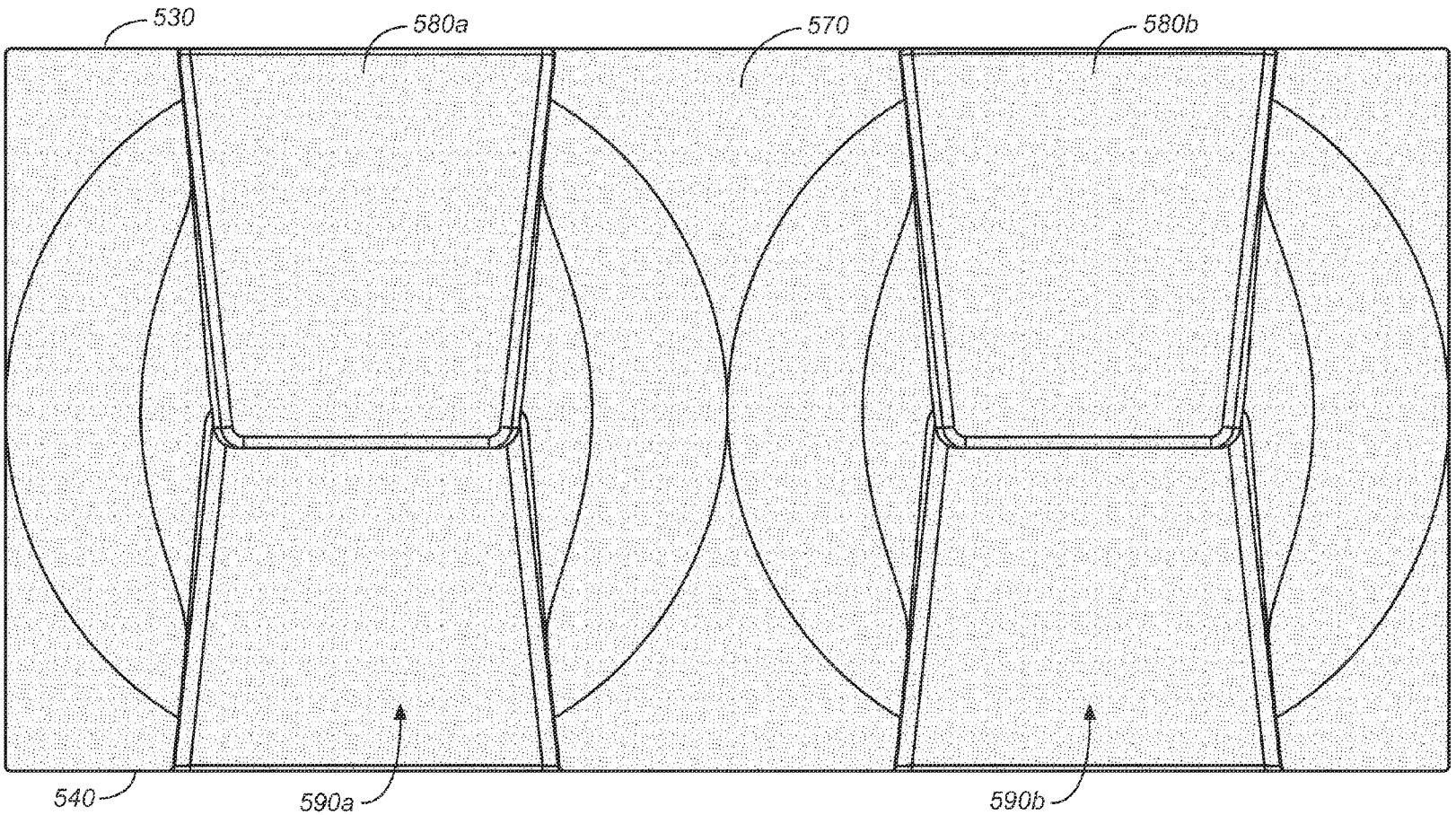
FIG. 18 is a rear view in elevation thereof.
Figure 19:
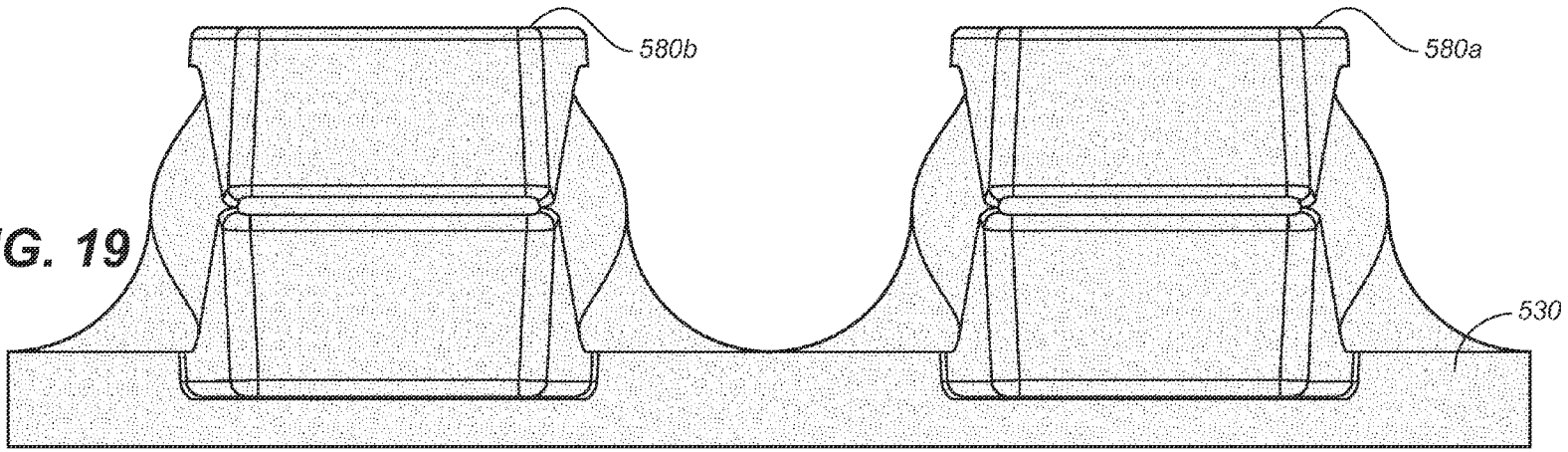
FIG. 19 is a bottom view thereof.
Figure 20:
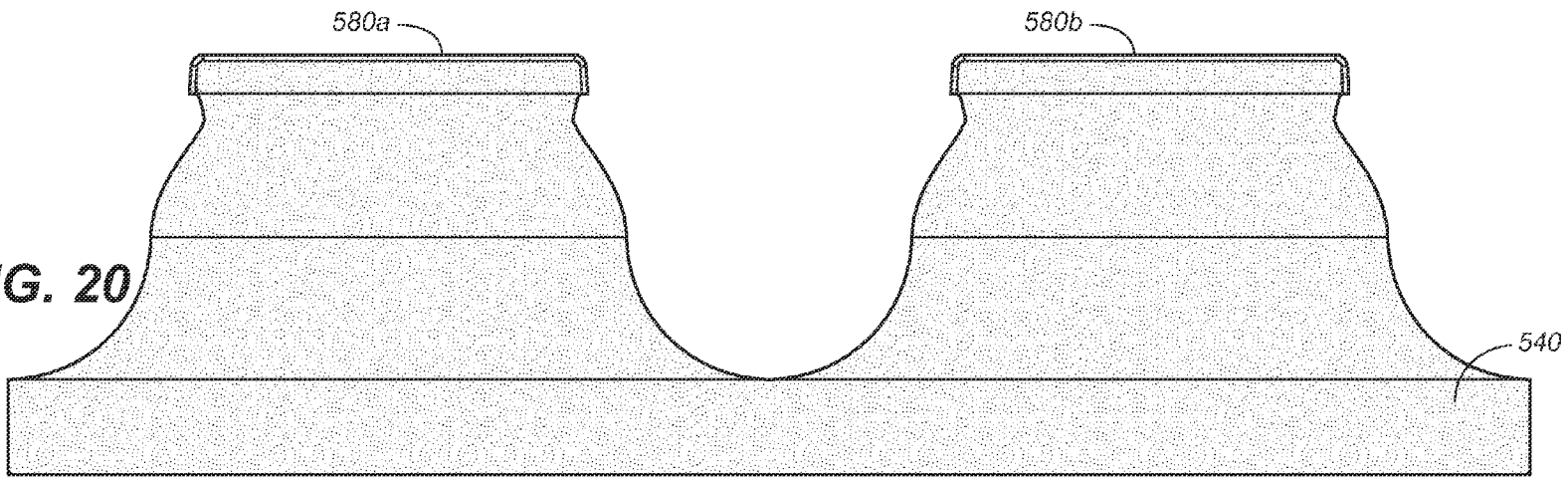
FIG. 20 is a top plan view thereof.

From FIGS. 2 and 3, it will be seen that the blocks may be joined such that each block 380*a* cooperates with only one other block 380*b* (see FIG. 2) or such that each block 390*a* cooperates with two other blocks 390*b*, 390*c* (see FIGS. 1 and 3). In either case, the course comprises blocks that are oriented with the toe pointing down interacting with blocks oriented with the toe pointing up.

Referring now to FIGS. 2-4D, it will also be appreciated that when the blocks are interlocked and stacked, a plurality of continuous cylindrical horizontal and vertical voids 400, 410, as well as diagonal voids (not shown) are formed between the blocks. Into these voids rebar 420 may be disposed both vertically and horizontally and the voids then filled with concrete. Alternatively, a matrix or grid of unit-placed rebar may be prefabricated, and the blocks may subsequently be installed and the wall constructed around and onto the a prefabricated grid with the intersections of the grid wired, welded, or joined with plastic cable ties, all in a manner well known in the art.

Referring now to FIGS. 13-20, there is shown a second preferred embodiment 500 of the cementitious block of the present invention. This block includes all the structural features of the above-described (alternative) embodiment, including a monolithic cementitious block 510 having a generally planar front face 520, a first edge 530, a second edge 540, a first end 550, a second end 560, a back face 570, and at least one male interlocking element 580. Again, preferably each block includes two male interlocking elements 580*a*, 580*b*.

Male interlocking elements include elements identical to those of the first preferred embodiment, including a tapering conical leg which projects and extends outwardly into an integral ankle portion, which, in turn, expands into a shoe portion, which has a flat sole, a lateral upper portion, a medial upper portion, a flat toe, a heel, a vamp, and a topline. The edge of the adjoining upper and sole portions define a beveled feather, and the edges of the adjoining heel and upper portions are also beveled. The heel rake has beveling on its exposed edges.

Each male interlocking element includes an integral female interlocking element 590*a*, 590*b*, comprising a box shaped concavity having features identical to those of the female concavity of the first preferred embodiment, including a plurality of sides, including a sole side, a medial upper side, a lateral upper side, and beveling at each of the adjoining sides.

The structural distinction between the first and second preferred embodiments is at the edges, where in the second preferred embodiment no rabbetting is provided.

The inventive cementitious block of the present invention is scalable to any size, and it is therefore designed for numerous uses, most notably for use in a wall system for constructing residential structural and commercial spaces, office building walls, and landscaping walls similar to those using the prior art ICF systems described above, including Rastra, Perform Wall, Apex, and Chempo. It is a two-part system using a unit from a single design that comprises identical opposing interlocking blocks that cooperate with one another to lock and stack to form a permanent insulated wall. The voids formed in the combination of block elements provides a form system for the containment of reinforced concrete. The novel design allows for the prefabrication and unit placement of steel reinforcement bars and the placement of interlocking wall units using the pre-placed rebar grid. The interlocking connection is fail safe and requires no adhesive or external shoring and bracing while the internal voids are filled with concrete.

The above disclosure is sufficient to enable one of ordinary skill in the art to practice the invention, and provides the best mode of practicing the invention presently contemplated by the inventor. While there is provided herein a full and complete disclosure of the preferred embodiments of this invention, it is not desired to limit the invention to the exact construction, dimensional relationships, and operation shown and described. Various modifications, alternative constructions, changes and equivalents will readily occur to those skilled in the art and may be employed, as suitable, without departing from the true spirit and scope of the invention. Such changes might involve alternative materials, components, structural arrangements, sizes, shapes, forms, functions, operational features or the like. Indeed, it should be readily understood that the present invention is scalable both dimensionally and conceptually.

Therefore, the above description and illustrations should not be construed as limiting the scope of the invention.

What is claimed as invention is:

1. A block wall building unit for constructing a block wall, comprising:

a monolithic block having a generally planar front face, a first edge, a second edge, a first end, a second end, and a back face;

at least one male interlocking element integral with and extending from said back face, each of said male interlocking elements including a tapering conical leg portion which projects and extends outwardly into an integral ankle portion, which, in turn, expands into a shoe portion that includes a planar sole defined by an outboard upper portion and an inboard upper portion, said upper portions being generally normal to said planar sole and adjoining said sole in outboard and inboard edges, a generally flat toe, a heel, a vamp, and a topline;

a female interlocking element integrally formed as a female concavity in each of said leg and ankle portions of said male interlocking elements, said female interlocking elements including a sole side, a medial upper side, a lateral upper side;

wherein when a first of said monolithic blocks is properly aligned with a second of said monolithic blocks, identical to said first monolithic block, each of said female interlocking elements on one of said monolithic blocks conforms precisely to a corresponding complementary male interlocking element on the second of said monolithic blocks because said heel portion of said male interlocking element slidingly inserts into said female concavity to form upper and lower interlocked blocks, the combination of said first and second monolithic blocks forming a portion of a course in a wall.

2. The block wall building unit of claim 1, wherein when said male element of a first of said monolithic blocks is inserted into a female concavity of a second of said monolithic blocks, said sole of said male element approximates said sole side of said female concavity and said inboard upper of said male interlocking element approximates said medial upper side of said female concavity.

3. The block wall building unit of claim 1, wherein said first and second edges are rabbetted, and wherein said first edge proximate said heel includes one or more projecting portions on an outer boundary of said first edge, while said second edge proximate said toe includes a projecting portion on an inner boundary of said second edge, whereby as said first and second monolithic blocks are interlocked with one another and additional monolithic blocks are stacked atop one another, said rabbetted first and second edges cooperate to form a joint that enhances the structural integrity of the block wall.

4. The block wall building unit of claim 1, wherein each of said monolithic blocks may be joined such that each monolithic block interlockingly mates with either one or two other of such monolithic blocks, and wherein a course of such interlocking monolithic blocks includes blocks oriented with said toe pointing down interlocking with monolithic blocks oriented with said toe pointing up.

5. The block wall building unit of claim 1, wherein when said monolithic blocks are interlocked and stacked, a plurality of continuous cylindrical horizontal voids, vertical voids, and diagonal voids are formed between said monolithic blocks.

6. The block wall building unit of claim 1, wherein said first and second edges of said monolithic block are generally planar.

7. The block wall building unit of claim 1, wherein said first and second edges include a rabbet.

8. The block wall building unit of claim 1, wherein said monolithic blocks are fabricated from a material selected from the group consisting of lightweight concrete, cellular concrete, glass fiber reinforced concrete, cellulose fiber reinforced concrete, expanded polystyrene foam, and recycled expanded polystyrene foam bead concrete.

9. The block wall building unit of claim 1, wherein at least one pair of adjoining sides of said male interlocking element converge in a beveled edge.

10. The block wall building unit of claim 1, wherein said heel includes a rake portion with beveling on its exposed edges.

11. The block wall building unit of claim 1, wherein each concavity of said female interlocking elements includes beveling at each pair of adjoining sides needed to complement corresponding beveling on any of the adjoining sides of said male interlocking element that include beveling.

* * * * *